United States Patent [19]

Ruben

[11] 4,435,131

[45] Mar. 6, 1984

[54] LINEAR FLUID HANDLING, ROTARY DRIVE, MECHANISM

[76] Inventor: Zorro Ruben, 8923 Bronx, Skokie, Ill. 60077

[21] Appl. No.: 324,030

[22] Filed: Nov. 23, 1981

[51] Int. Cl.[3] ..... F04B 19/00

[52] U.S. Cl. ..... 417/334; 417/436

[58] Field of Search ..... 417/334, 436; 416/77, 416/81; 62/324.6

[56] References Cited

U.S. PATENT DOCUMENTS

| | | | |
|---|---|---|---|
| 12,190 | 1/1855 | De Bergue | 417/436 |
| 419,321 | 1/1890 | Courtright . | |
| 813,430 | 2/1906 | Hunter . | |
| 873,539 | 12/1907 | Guenther . | |
| 945,701 | 1/1910 | Courtright | 417/436 |
| 1,093,696 | 4/1914 | Guenther | 417/436 |
| 2,152,243 | 3/1939 | Daigor | 417/436 |
| 3,307,358 | 3/1967 | de la Roche Kerandraon . | |
| 3,599,401 | 8/1971 | Rich | 417/436 |

*Primary Examiner*—William L. Freeh

*Attorney, Agent, or Firm*—Wallenstein, Wagner, Hattis, Strampel & Aubel

[57] ABSTRACT

Fluid handling mechanism has a vane with parallel side edges coupled to a crank at one end and to an obliquely transverse guide track at the other end. The vane is closely runningly fitted, between parallel side walls and curved top and bottom walls, executing a longitudinally moving line contact with the curved walls in conjunction with irrotational, purely linear, fluid flow. This contact may range from zero to a substantial clearance. Flow is combined fluidynamic fan effect and positive displacement. The positive displacement portion is increased when two such mechanisms are assembled tandemly, in series, with the vanes piano-hinged together. The four walls form a duct, the ends of which may be ported or valved. The duct may also be closed at its ends to constitute a chamber, allowing the mechanism to serve as a closed cycle regenerative gas engine. Mechanism provides interconversion of fluid and mechanical energy for ship propulsion, generation of hydro-electric and wind power, gas compression and evacuation, cryogenic machines, and steam and compressed air turbines.

23 Claims, 14 Drawing Figures

Fig 1
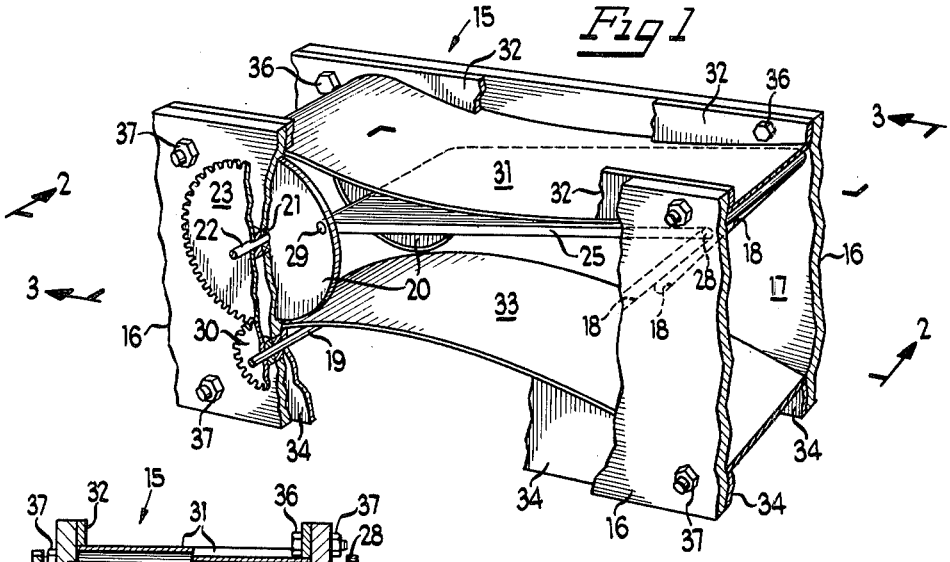
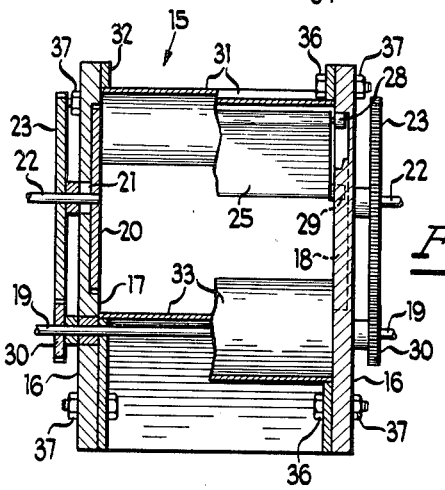
Fig 3
Fig 2
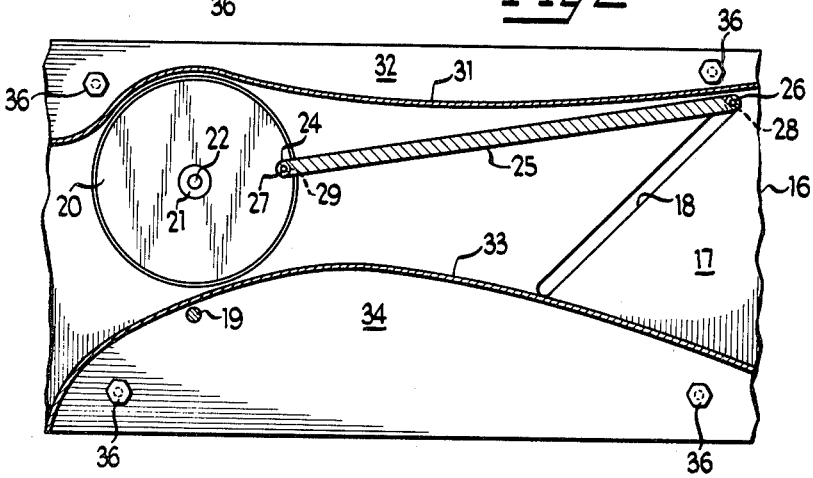

| FLOW CHART | |
|---|---|
| ABOVE VANE | BELOW VANE |
|  |  |
| A-P.D. EJECTION, FRONT | C-FAN EFFECT EJECTION |
| B-P.D.SUCTION, REAR | D-P.D. EJECTION, FRONT P.D. SUCTION, REAR |
| C-FAN EFFECT SUCTION AND MOMENTUM FLOW | E-P.D. SUCTION ONLY |
| H-INDUCTION AIDED MOMENTUM | F-INDUCTION AND FAN AIDED MOMENTUM |
| I-MOMENTUM MOSTLY | |
| J-FAN EFFECT EJECTION | G-MOSTLY MOMENTUM |

LINEAR FLUID HANDLING, ROTARY DRIVE, MECHANISM

BACKGROUND OF THE INVENTION

1. Field of the Invention

The present invention relates to mechanism which propels and/or is propelled by fluid, a term which includes both liquid and gases. It thus comprises means for the propulsion of vessels or vehicles, the generation of hydroelectric and wind power, the compression and evacuation of gases, the pumping and blowing of liquid and gas, the production and use of mechanical power in a closed cycle regenerative thermal machine, and other, fluid with mechanical energy conversion machinery.

2. Prior Art

In 1854, shortly before the paddle wheel was to be substantially replaced by the screw propeller, Charles de Berque of London, was granted a patent on a more or less horizontal, rectangular "oscillating fin", or vane, carried in a "paddle box" on the side of a ship. A central cross-arm, integral with the vane, extended upward of the paddle box to a deck above, where the end of the arm was rotated by a crank, driven by an engine. A link from the front end of the paddle box to the center of the vane, constrained the vane's center to a short, almost vertical, reciprocating arc of long radius. The de Berque vane was thus given an efficient fluid propelling motion, similar to that of the present invention. However, the de Berque vane ends moved on an elongated figure-eight curve, significantly different from the motion of the present invention's vane ends. The de Berque device had additional disadvantages, among which were an intricate mechanism and excess drag due to the blocking area of the cross-arm.

More recent prior art, involving a parallel sided vane within closely fitted side walls, was developed by 0. G. de la Roche Kerandraon. The vane of his apparatus is reciprocated across a duct of rectangular cross-section by a cross-arm which passes through an opening in a duct wall and which is loosely pinned or hinged to his vane near a one-third point on the vane's longitudinal center line. The de la Roche Kerandraon apparatus suffers four disadvantages: First of all, the essential looseness of the vane's hinge to the reciprocating cross-arm is believed to result in noisy and destructive percussive contact of the vane's closer end, and abrasive sliding of both of the vane's ends, with the top and bottom walls. Also, the reciprocating power supply adds to the complexity of its drive as compared with a rotary power shaft. The flow through this apparatus is not reversible, and the cross-arm contributes to fluid drag.

An older development by E. P. Guenther, in 1907, presented a device similar to de la Roche Kerandraon's except that the reciprocating power input of Kerandraon was replaced by a wheel crank. Guenther's rotary drive, however, produced even more adverse friction and abrasion at his vane's ends and still suffered the same adverse loosely flapping condition and other disadvantages, of the Kerandraon device.

In 1890, E. Courtright developed a device similar to de Berque's, but replacing de Berque's linkage constraint of the central area of the vane with veritcal slide rods operating through holes in the vane. Thus the central portion of the vane reciprocated in a short vertical straight line motion rather than on de Berque's short, almost vertical, arc. However, both, de Berque's and Courtright's vane ends moved on similar figure-eight paths, a condition which makes it difficult and impractical to attempt to provide an adequate seal of the vane end against an end wall, for the purpose of providing a useful chamber surrounding the vane, as provided by the present invention.

Although de Berque could have employed Courtright's curved top and bottom duct walls to advantage, both would have suffered from a difficult to seal upper wall, in which a longitudinal slot is required to clear the fore and aft motion, with respect to the duct, of the lower section of the vane's cross-arm.

A multi-bladed conventional screw propeller or turbine also has some disadvantages. These include the energy loss of the rotational energy imparted to the fluid, along with the axial thrust or torque produced, and the drag due to the blocking area of the propeller's central hub.

SUMMARY OF THE INVENTION

Accordingly, it is one object of the present invention to provide a controlled, not loose or flapping, vane motion, as in prior art cited coupled with the desired elimination of mechanical complexities and drag introduced by cross-arms. It is an ancillary object, with the elimination of the aforesaid cross-arm, to eliminate the pressure escaping slot in a duct wall that the cross-arm entails.

It is a further object of my invention to provide the aforesaid controlled motion of a vane in which moving contiguity of the vane's large surfaces with two curved duct walls can be supplemented with sliding contiguity of the vane's ends with a partial extension of a curved wall or with completely enclosing walls at both ends of the vane.

The essential feature of the present invention is the provision of a vane which is subjected to rotation near one end of its length while it is constrained to obliquely transverse reciprocation near the other end. The parallel sided vane of this invention is thus given a specific, mechanically controlled motion, in which one longitudinal end, followed by the other, moves across the fluid path, followed by the first, then by the second, and so on, in a continuous sequence. Thus, rotation of the fluid race is avoided and this specific energy loss of a screw propeller is eliminated. Flow velocity, from one side of this vane to the other, is fairly constant, in contrast with the variation of velocity from the center of a screw propeller to the outer extremities of the blades, a circumstance producing noise and cavitation. Furthermore, there is no flow blocking element, in or near the vane or its mechanism, such as a propeller's hub or, as in the case of prior art vanes cited, cross-arms to impede the flow.

Since the mechanism of this invention fixes the position of the vane throughout its cycle, with a controlling element at each end, there is no indeterminate looseness in the vane to result in adverse flapping, or abrasive friction as occurs in the Kerandraon or Guenther devices. Partially for the above reasons, this invention provides an effective alternative to the screw propeller, especially when there is a need, such as in ship propulsion, for increased propelling or towing efficiency, or bow thrusting. The motion of the vane, as provided by the mechanism of this invention, is in itself capable of engaging in a longitudinal thrust reaction on the surrounding fluid, producing an effect similar to that of a scuba diver's fins. With the addition of the two closely fitted parallel walls, herein referred to as side walls, this thrust is somewhat augmented, since these side walls close off lateral flow.

In accordance with a form of the basic mechanism of the present invention, the most significant augmentation of thrust and/or longitudinal force reaction, is provided by curved top and bottom walls. These walls, which are convexly curved with respect to the interior of the resulting duct, present surfaces, one of which is contiguous with an upper surface, and one with a lower surface of the vane in most of its positions. The envelopes of these curved walls, when operating in juxtaposition with the vane, produce a contraction of the fluid volume between the two surfaces at one end of the vane, while simultaneously expanding a similar chamber at the other end. This action alternates from one side of the vane to the other during each revolution and produces two positive displacement pulses per revolution separated by two periods of fluidynamic "fan effect", and viscosity induced ejection assistance to momentum flow. The latter periods of such "fluidynamic" flow occur while the vane is out of contact with either wall and is moving transversely across the duct while at a fairly constant angle with it. These period's durations total on the order of 40 percent of the revolution, while the positive displacement pulses obtain during the major, 60 percent, portion of each revolution, in the basic mechanism with a fully open ended duct. Also, in this mechanism, the duct is always open, from end to end, in some degree. It can be widest open when a vane is parallel to the longitudinal central axis, and least open, when the vane is crossing over the duct at its maximum angle with that axis. During each revolution of the "basic mechanism", while positive displacement is occurring on one side of the vane, the duct is more or less open on the other side. This can result in fluid slippage and in lowered efficiency under conditions of low volume throughput as might be encountered under slow rotary speed, or high fluid pressure differential conditions.

A modification of one of the curved walls, as next delineated, contributes to an increase in the percentage of positive displacement per revolution. This serves to reduce unwanted flow slippage, thus furthering the utility of this embodiment as a low head water turbine or pump. This modification is made by an extension of one of the curved walls, wrapping it around the rotating end as much as, or more than, one quadrant. While reducing the width of the opening at that end to as little as one half, it serves to add to the positive displacement portion on the order of one-quarter revolution, thus increasing the percentage time of positive displacement effect. This extension can also result in a complete closure of the duct at one or more positions of the vane, during which flow would then be effectively throttled, if the vane were to slow to a stop. However, it must also be recognized that, while more positive displacement is occuring between one side of the vane and its adjacent convex wall, the space on the other side may still present a problem with higher upstream pressure applications. Speaking of the mechanism as a pump, fluid in the spaces on the side of the vane, opposite to the side on which positive displacement is occurring is in some degree resistant to backflow due to the viscosity transmitted momentum induced by the positive displacement on the other side and to the fluidynamic fan effect of the angular cross movement of the vane. A simple combination of two basic mechanisms can be made by pianohinging two vanes together at their longitudinal ends. A two stage turbine or pump may thus be provided, having an average relative open duct area on the order of one-fourth that of a single basic mechanism. This will be capable of operating more efficiently, with greater thrust forces and a larger differential between upstream and downstream pressures. It also provides positive displacement throughout the full 360 degree cycle of each revolution.

The configuration, of the basic mechanism, with articulated vanes, of equal size, hinged on one rotor crank, powered by a motor or engine rotating the crank, lends itself quite suitably for service as a ship's bow thruster.

Thus far, this summary has covered the case of this invention's mechanisms operating within open ended ducts through which fluid flows, from and to an external system, without the intercession of valves.

Because the motion at one end of the vane is circular, and the obliquely transversely reciprocating end moves back and forth in both directions, on the same simple path, the ends of the four walled duct may be closed, and sealed closely, against the moving vane ends. The mechanism can thus be enclosed within a chamber in which the only opening is the easily sealed power shaft. Furthermore, valved openings may be placed, in the chamber, near the corners of the duct walls, preferably the curved top or bottom walls. These circumstances further the utility of the mechanism for specialized forms of fluid turbines, pumps, closed cycle regnerative gas engines, cryogenic machines, and low pressure steam and compressed air turbines.

In summary, the various forms of the present invention are a fluid energy machine including one or more vanes, having parallel, generally longitudinally directed side edges and longitudinally spaced apart ends, each of which receives motion from or imparts motion to a fluid and is uniquely supported for specific motion wherein the vane ends alternately pivot transversely across the longitudinal direction of fluid flow in a manner which increases the effectiveness and efficiency of the interaction between each vane and the fluid involved. More specifically, one end portion of each vane is constrained substantially to rotary motion and the other end portion of each vane is constrained substantially to reciprocation motion along lines of reciprocation which cross the longitudinal direction obliquely. In its most effective form, the vane or vanes of the machine are enclosed within a conduit comprising a pair of side walls at the opposite parallel edges of each vane, where the side walls extend transversely of the opposite faces of each vane, and are contiguous to the side edges thereof over the entire range of movement of each vane. The conduit also preferably includes a second pair of walls extending transversely between the conduit side walls, the second pair of walls curving inwardly of the conduit and positioned to make changing line contact at different times with the opposite faces of each vane as the vane rocks and moves back and forth therebetween.

The above and other features and advantages and a fuller understanding of my invention will become apparent from a consideration of the specification, drawings and claims which follows.

BRIEF DESCRIPTION OF THE DRAWINGS

FIG. 1 is a perspective view of an embodiment of a basic mechanism of this invention, having portions broken away, including four enclosing walls, one pair of wheel cranks, one pair of obliquely transverse guiding tracks, and one vane shown in one position;

FIG. 2 is a side elevation of a central longitudinal cross-section, taken along the line 2—2 of FIG. 1:

FIG. 3 is a staggered elevational cross-section, taken along the line 3—3 of FIG. 2;

DESCRIPTION OF EXEMPLARY FORMS OF THE INVENTION BASIC FORM NO. 1 (FIGS. 1-3)

Figure 4:
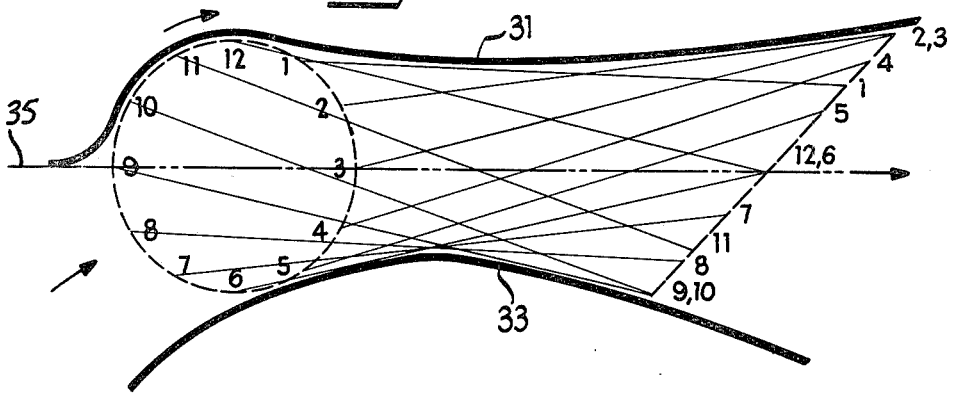
FIG. 4 is a diagrammatic depiction of the basic mechanism of FIG. 1, showing 12 positions of the vane, and the contiguous position of the curved upper and lower walls.
Figure 4:
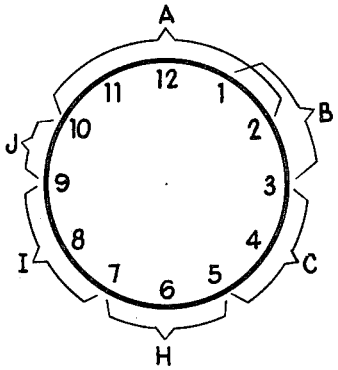
Figure 4:
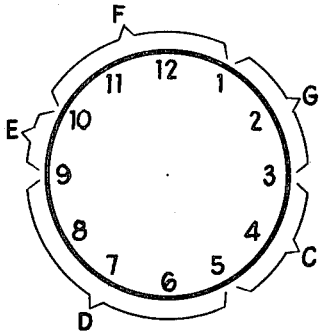

Referring to FIGS. 1, 2 and 3, a basic mechanism for a fluid handling machine is indicated generally by the numeral 15. The machine 15 includes opposing right and left side, parallel, supporting walls 16 which provide a base. On the interior facing sides 17, of walls 16, near one end thereof, exactingly placed, opposite and parallel to each other, obliquely transverse guides 18 are provided. In this case, guides 18 are formed as shallow straight line slots in walls 16, placed at a 45 degree angle with the base of the machine. The guides 18 may also be curved, and the angularity may range, roughly, from as little as about 30, to as much as about 55 degrees, with the base of the machine, to meet differing flow conditions and fluid medium requirements.

Near the other end of walls 16, interior facing sides 17 are each provided with exactingly opposed circular recesses, in the centers of which are closely clearing, runningly fitted, wheel crank discs 20. Each disc 20 should effectively fill the depth of the recess in wall 16 so as to have its interior face flush with the interior face 17 of wall 16. Discs 20 are positioned with bearings 21, in the walls 16, by power shafts 22 which are firmly and squarely secured to the discs, for example, with threaded ends.

Each power shaft 22 projects sufficiently from the exterior of the wall 16 to make possible a connection to the shaft of a motor or a generator. The power shafts may also, as in this embodiment, support spur gears 23. Each disc 20 is provided with an eccentrically located bearing housing 24 (FIG. 2) close to its rim. Closely positioned, but freely movable, between wall faces 17 and discs 20, is the fairly thin, parallel side edged vane 25. Vane 25 is provided with parallel axle shafts 26 and 27 located near, and secured within, the vane's longitudinal ends. These shafts extend out of the vane only sufficiently to secure the inner races of ball bearing pairs 28 and 29 respectively. Bearings 28 are runningly fitted to roll within the obliquely transverse guiding slots 18 in walls 16, and bearings 29 are located to rotate in the eccentric housings 24 in wheel crank discs 20. Thus, one end of the vane is contrained to reciprocate back and forth, once, with each revolution of the other end. Completing the enclosure around the vane 25 within a four walled duct of rectangular cross-section, of constant width but somewhat varying height, are two curved walls formed as follows:

The longer upper wall 31, mostly curved on the order of a segment of a long radius circle, is secured to the matchingly curved edges of two bracing walls 32, as by adhesion or welding. The shorter lower wall 33, mostly curved on the order of a hyperbola is similarly secured to two opposite and equally curved edge bracing walls 34. The curvature and positioning of the upper wall is such that its inner surface is contiguous to an upper surface of the vane, and the lower wall's corresponding surface is contiguous to the lower surface of the vane in all of the vane's positions except where the vane moves from one side of the duct to the other while in a relatively constant angular position. To maintain contiguity and clearance, as the vane end moves along the circular portion of the upper curved wall 31, its longitudinal end, enclosing shaft 27, is rounded.

The width of the curved walls 31 and 33, and the outside dimension, side-to-side, between walls 32 and between walls 34 respectively is only slightly greater than the width of the vane 25—just enough to allow a running fit. Assembly of those parts of machine 15, heretofore described, is made with hex bolts 36 and hex nuts 37 in aligned holes in walls 32, 34 and 16.

While not essential to the practice of this invention, a pair of spur gears 23 may advantageously be placed on shafts 22, and an auxiliary shaft 19 may then carry smaller pinion gears 30 to mate with gears 23. Power may thus be applied or taken off at a higher rpm through shaft 19. Also, the auxiliary shaft and gear assembly, by distributing and equalizing the torque at each end of the axle shaft 27, permits a desirably long and thin member, such as 27 to serve adequately as a crank pin.

Although the embodiment 15 of the fluid mechanism, as shown in FIGS. 1 through 3, is an entity, the four walled duct, of a machine formed such as 15, may be attached alongside or within a ship, and submerged in water to provide propulsive means when driven by a motor or engine. Another form may be mounted on a tower or building roof to generate electricity from wind, or attached submerged, to or within a dam or pier, for the generation of hydroelectric power.

In another application, a form of the mechanism 15 could be connected, at each end, within a pipeline and powered as a pump, or it could be open at one end and piped at the other. Since fluid pressures apply bending stress, like the continuous loading of a beam, on the vane, it should, more effectively, be somewhat thicker at its middle section than at its ends. Thickening the vane gradually, from its ends to its center will result in some flattening of the convex top and bottom walls of the duct. It is usually desirable to hold the clearance between the vane's large surfaces and these walls to a practicable minimum. However, as in cases such as when particulate matter may be carried by the fluid, the clearance may be intentionally increased.

Another useful variant of vane construction, when extreme light weight would be desirable, such as in an embodiment serving as a windmill, would be provided by a metal frame of the two axles, 26 and 27, welded to two parallel sides, to which a resilient sheet of neoprene, or sailcloth, would be fastened.

FIG. 4 indicates 12 positions of the rotating end of vane 25 on the dotted circle at the left. The vane's 12 positions are represented by the solid straight lines, terminating, at the right end, on the dotted straight line representing the obliquely transverse guide track, on which the corresponding position numbers, from 1 to 12 are also indicated. The lower solid curved line, from the dotted circle to the dotted guide track, represents the curved lower wall 33, contiguous to the lower side of the vane throughout its movement from 5 to 10. The upper solid curved line, from the dotted circle to the dotted obliquely transverse guide track, represents the curved upper wall 31, contiguous to the upper side of the vane throughout its movement from 12 to 3. The upper curved wall 31 is continued, partially, around the circularly moving vane end, in this case breaking away from contiguity therewith between 9 and 10. Direction of flow is to the right when the rotary end turns clockwise, whether the mechanism is operating as a pump or as a turbine. Fluid would move to the left with counterclockwise rotation. The chart accompanying FIG. 4 characterizes the fluid action based on the mechanism's operation as a pump with clockwise rotation.

In explanation of and referring to the chart, "P.D." is the abbreviation for positive displacement. This defines the effect, when a fairly well sealed chamber either contracts or enlarges, causing ejection or suction, respectively, of fluid. For example, when vane 25 moves one third of a revolution, from positions 10 to 2 (A on flow chart), the contracting volume of fluid, to the right of the line of contiguity with the wall 31, above the vane, is thus forcibly ejected, while, from position 1 to 3 (B on chart), to the left of the line of contiguity, the "chamber" above the vane is enlarging, causing positive suction intake of additional fluid. From 3 to 5, (C on chart), the angularity of the vane is fairly constant, i.e., it traverses the duct, from upper to lower curved walls, at a fairly steady inclination. This is a period of so-called "fan effect" in which ejection below the vane, and suction above, is similar to the reaction of air as propelled by a hand held fan. Thereafter, below the vane, from 5 to 9 (D on chart), for another one-third revolution, we have positive displacement ejection under the vane, in front of the line of contiguity, and positive suction behind it. Thus, for two-thirds of each revolution, an easily calculable volume is being positively discharged or ejected.

While, starting from 10, positive displacement ejection is taking place above the vane, the duct below the vane is opening. It reaches its maximum open size near 1. The space below the vane then becomes a fully open, unrestricted duct from end to end. However, starting at 10, the viscous shear of the fluid being ejected above the vane induces flow below the vane in addition to that caused by the momentum of its mass. This "induction aided momentum" is considered to end near position 1, when the remaining momentum must carry the fluid below the vane on through position 2 or even 3.

Continuing the consideration of flow below the vane, from 9 to 10 (E), the vane merely pivots at the low point of the obliquely transverse guide track-as it did from 2 to 3 at the highpoint-while it completes the positive displacement suction intake period that started at 5.

In this embodiment, only for an instant, at position 10, the intake end of the duct is completely closed to the discharge end. In other embodiments, this closure effect may prevail for a substantial portion of the entire 360 degrees of each revolution.

Continuing with consideration of flow below the vane, from 10 to 1, (F), inlet momentum is aided by the induction and fan effects previously mentioned. From 1 to 3 (G), the flow is mostly momentum, although, shortly after 2, there is some aid from the beginning of fan effect.

Reverting now to flow above the vane, previously charted from 10 to 5, we find some induction aided momentum flow from 5 to 7 (H), dropping off to plain momentum from 7 to 9 (I), followed by fan effect ejection from 9 to 10, (J).

When considering the dynamic conditions of flow, as exhibited in FIG. 4, it should be noted that the "upstroke" on the obliquely transverse guiding track, from 10 to 2, occurs in one-third revolution, while 5 the "downstroke", from 3 to 9, is slower and occurs in one-half revolution. Thus, the reciprocating vane end goes "up" 50 percent faster than it comes "down", assuming constant rpm at the rotating end.

BASIC FORM NO. 2 (FIG. 5)

Figure 5:
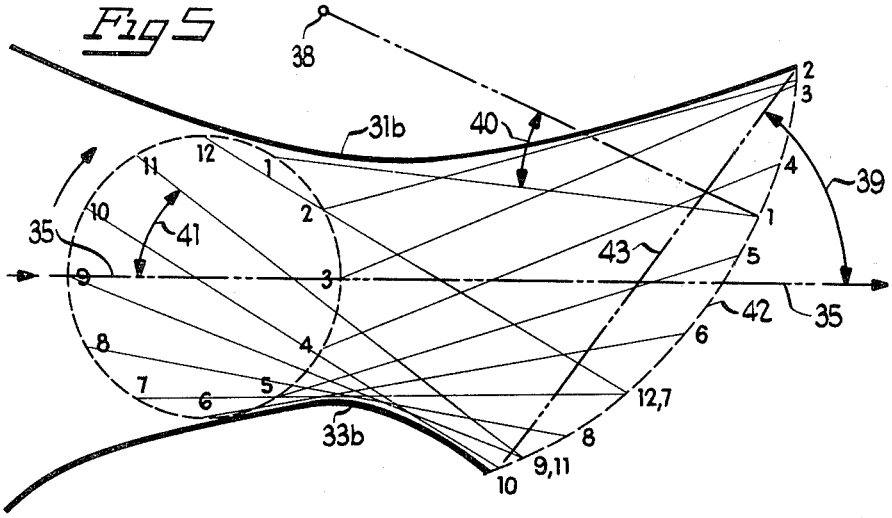
FIG. 5 is a diagrammatic depiction of an alternate basic mechanism, of proportions suitable for wind energy conversion, showing the positions of the vane and curved walls, as in FIG. 4.

The proportions of the basic mechanism 15 of FIG. 1, postulated as a fluid pump in FIG. 4, are changed, as in FIG. 5, to accommodate to the low density of air when the mechanism is to be employed as a wind turbine. Here, it is desirable to increase the acute angle, that the transverse guide track makes with the central longitudinal axis 35, to a practical maximum. This angle can be made larger by employing a curved track, as indicated by the uniformly dotted line 42 having its center at 38. The angle 39, made by the chord 43 of the circular segment track, with the central axis 35, is arbitrarily stated as the angle of the track. This angle, in this case, is somewhat under 55 degrees as compared with the 45 degrees of FIG. 4.

Increasing the track angle 39, serves first to open the height, or space between the curved walls, 31B and 33B, of the duct and, second, to increase the maximum vane angle 41, at position 11. This angle, of approximately 37 degrees, compares with the 19 degrees of the vane angle of FIG. 4 at position 10. The increased vane angle enhances the efficiency of that portion of the cycle, described as fan effect, in FIG. 4. This becomes more important here, since the inlet opening is desirably wide as practicable, and not restricted by a circular curve extension such as is continued around the rotary end in FIG. 4. There is, however, a basic limitation on the maximum angle that the obliquely transverse guide track may assume. This limitation is the minimum acceptable resulting angle 40, between the vane and a perpendicular to the track.

In FIG. 5 the perpendicular to the track is the radius emanating from the center point 38, shown meeting the track at vane position 1. The angle 40, near its minimum at vane position 1, is approximately 16 degrees. Increasing angle 39 would result in a reduction of angle 40. A second dimensional relationship, length of vane to radius of crank circle, can affect the resulting angle 40. In this case the ratio is approximately 3.5 to 1. Shortening the vane length, or increasing the crank radius, will reduce angle 40. The angle 40 is desirably maintained on the order of 15 or more degrees to prevent torsional force on the circular vane end, and frictional resistance at the guide track from exerting undue longitudinal force and insufficient lateral force at the track end, which could create a stalling condition at a vane position near 1, if, and when, torque is being applied by the power shaft 22, or 19.

FIG. 5 is actually the diagrammatic representation, in the manner of FIG. 4, of a basic mechanism, delineating 12 positions of a vane within a four walled duct, with clockwise rotation, and fluid flow to the right, as designated by the arrows, but, in this case, serving as a wind energy conversion machine.

It may be assumed, for this case, that we are looking at a plan view of the mechanism, i.e., the power shaft is vertical, and that a plurality of such mechanisms are stacked up, one above the other, with the shafts coupled in line, and located within a hollow central supporting tower, at the foot of which is an electrical generator.

An analysis of wind effect at various vane positions will show that the torque developed by wind will vary in the cycle according to the position of a vane. It is therefore recommended, as is known in the art, that a series of such parallel mechanisms be assembled with their vanes in appropriately different positions.

Referring to FIG. 5, and starting from position 10, wind, entering and passing below and above the vane, exerts an airfoil and fan effect pressure and lift, moving the vane across the duct and producing substantial clockwise torque to position 12. From position 12 to 1, fan effect of wind on the underside of the vane, continues to produce torque and to eject the air above the vane. Approaching position 1, torque production drops off drastically. Continued motion is then provided by momentum of the mechanical parts and the vane until, approaching position 2, the wind again exerts a fanning and airfoil effect, moving the vane back across the duct to position 6, producing maximum torque and work during this period.

At 6 the torque applied to the power shaft by the wind is diminishing, as the vane starts a rolling and pivotal motion, around the high point of curved wall **33*b***. This motion continues to 10, the starting position aforementioned. Near position 7, where, once again in the cycle, continued motion is due substantially to the momentum of the moving parts, wind, entering below the vane, starts to apply torque to the circular end and eject air below the vane at its reciprocating end. Airfoil and fan effect pressure becomes substantial again at 8, and continues to increase torque, to the point, at 10, where this cycle description started.

The windmill is almost feathered, and can be locked against rotation at some point near position 1, when it appears that increasing wind velocities may exceed the structural resistance of the construction.

BASIC FORM NO. 3 (FIGS. 6–9)

Figure 6:
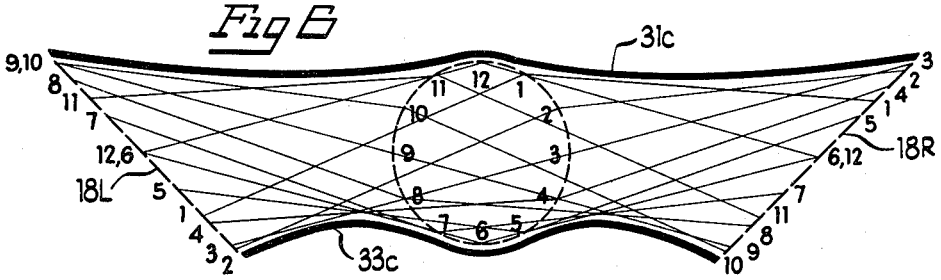
FIG. 6 is a diagrammatic depiction of a symmetrical tandem mechanism, suitable as a reversible turbine and a ship's bow thruster, provided by two vanes, piano-hinged together on a single crankshaft.
Figure 7:
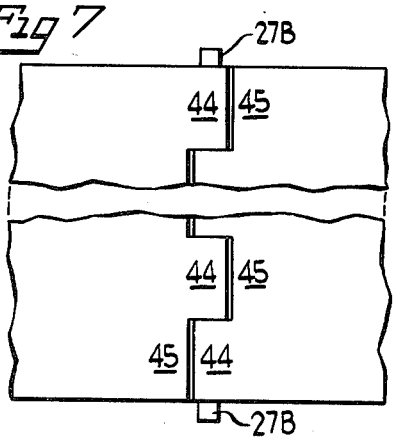
FIG. 7 is a fragmentary view, showing the piano hinge and crank pin, of the tandem vane of FIG. 6.
Figure 8:
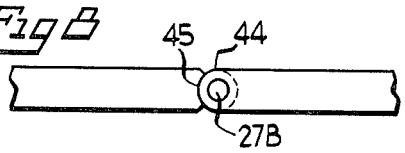
FIG. 8 is a longitudinal side edge view of the fragments shown in FIG. 7.

Referring to FIGS. 6 through 9, FIG. 6 presents the positions of an articulated vane, consisting of a left and right half, joined by the piano-hinge detailed in FIGS. 7 and 8. The hinge pin, in this case, is the circularly moving axle shaft 27B, shown in the 12 "clock" positions of FIG. 6. The distal ends of each half vane move on the contra-transversely angled guide tracks 18L and 18R, each marked with the position numbers corresponding to the circular end.

While the curved top and bottom walls, 31C and 33C respectively, are closely contiguous to the vane's surfaces throughout its cycle, they depart somewhat from 5 to 7 and 11 to 1 to provide clearance for a small amount of what would otherwise be trapped fluid.

Figure 9:
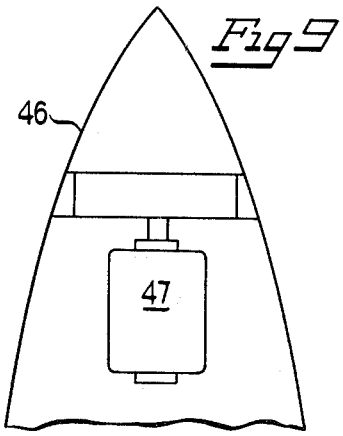
FIG. 9 is a plan view of a bow deck fragment of a ship, below the water line, showing the arrangement of the mechanism of FIG. 6, with a reversible motor, for operation as a bow thruster.

Details of the articulated vane's hinge joint are shown in the face and edge views, FIGS. 7 and 8, respectively, where each half vane has alternate projections 44 and notches 45. The notches 45 have circularly grooved surfaces to seal against the circularly rounded edges of the projections. FIG. 9 presents the advantage of this tandem embodiment's configuration 46, when directly driven by the reversible electric motor 47, and located on a deck, below the water level, near the bow of a ship 48. The motor drive and fluid mechanism's shafts are horizontal. Doors in the ship's sides, at the duct's ends, not shown, are preferably hinged at the bottom to open when bow thrusting is required.

As may be observed, by noting the area swept in each position to position sequence, whether clockwise or counterclockwise, this tandem vane assembly provides positive displacement, from one or both of the vane halves, throughout the 360 degree cycle of each revolution. Observe, for example, vane movements from 10 to 12, and from 3 to 5 in FIG. 5, in which flow is fluidynamic or fan effect, on both sides of the vane, as it crosses the duct at a fairly steady angle with the center line. In FIG. 6, however, from 10 to 12 the fluid above the vane is being positively ejected. Similarly, in FIG. 6, from 3 to 5, the left half vane is positively ejecting under the vane.

Operating in the reverse direction, from 12 to 10, the left half vane is positively ejecting above the vane, and from 5 to 3 the left half, of the left half vane is positively ejecting under the vane, while producing positive suction under its right half.

This tandem vane arrangement also differs from the single vane basic mechanism in the duration of the portion of the 360 degree cycle in which the duct is open from end to end. For example, consider the articulated vane of FIG. 6 in positions 2, 3, 9 and 10. In these positions the duct is substantially closed, as between one end and the other, for a total of one-third of the cycle. There is only a slight opening therebetween at positions 4 and 8, and somewhat more at 1 and 11. The duct opening increases at 5 and 7 and is at its maximum opening, 50 percent, at 6 and 12. The average percentage of opening, over the 360 degree cycle, is on the order of 15 percent for FIG. 6 whereas it is on the order of 60 percent in FIG. 4.

Several characteristic elements of this articulated vane embodiment favor its performance as a ship's bow thruster. First, is its fully equal reversibility. Then, there is the reduced portion, of its cycle, of open duct, and the increased portion of positive displacement. These factors increase the ratio, of the thrust produced to the duct's cross-sectional area, for a given rpm. Lastly, there is the configuration shown in FIG. 9 which lends itself favorably to the shape of a vessel's bow.

Efficiencies of the combined fluidynamic and positive displacement character of the tandem mechanism embodiment of FIG. 6 result in improved utilization of low head water power. The fully equal reversibility of the symmetrical form of FIG. 6 indicates its suitability as a turbine for the reversing nature, and low head of tidal flows. In such application the power shaft would be vertical, and the reversible electric generator could be situated well above the maximum water elevation, using a long vertical power transmission shaft, as for the windmill of FIG. 5.

The fluid mechanism would be located just below the minimum oceanside level of the estuary dam. If the generator were to be motored, with electric power, at times of slack demand on the utility, the mechanism would operate as a pump, to raise the level on the estuary side of the dam for additional storage. The flow would then be reversed, to power the mechanism as a turbine, at times of heavy electrical power demand.

Figure 10:
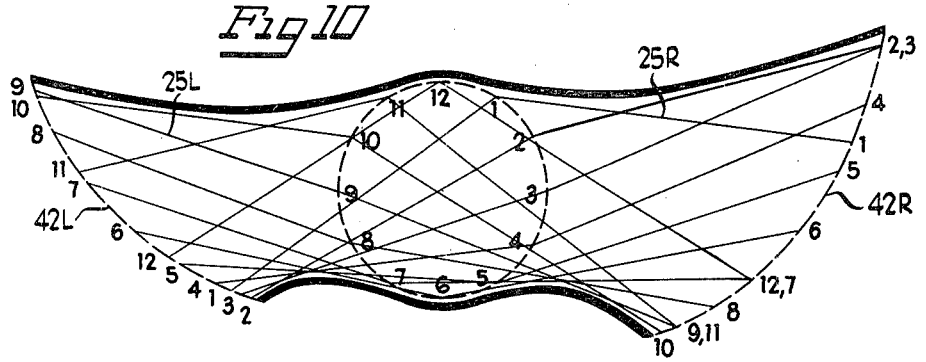
FIG. 10 is the non-symmetrical diagrammatic embodiment of FIG. 6, with articulated vanes as in FIGS. 7 and 8, for service as a two-stage pump and/or turbine.
Figures 13, 14:
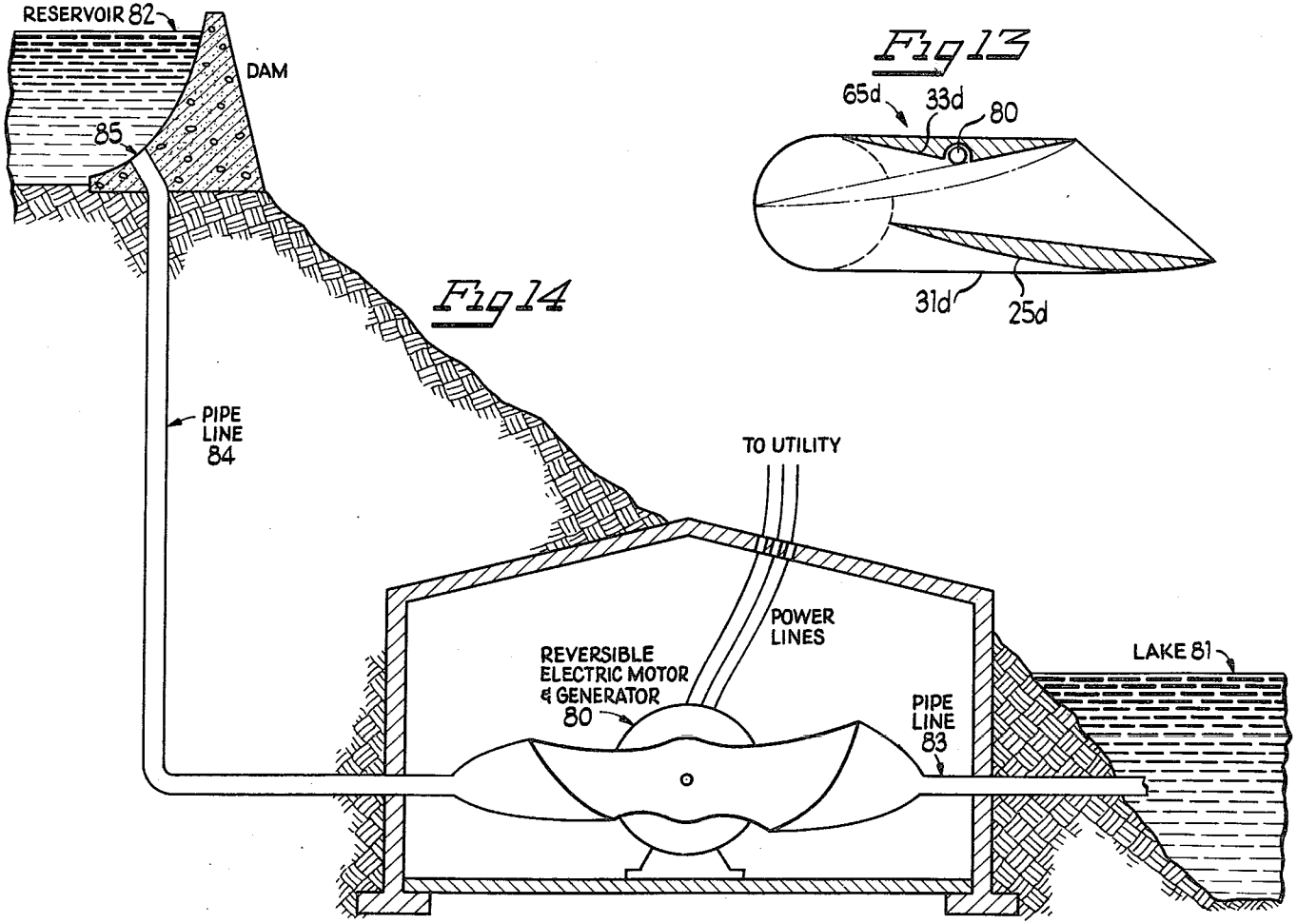
FIG. 13 diagrams a vane having a convexly curved surface enclosed within modified walls for higher pressures as may be found in the machine of FIG. 12.
FIG. 14 diagrams the fluid mechanism of FIG. 10 as the fluid energy conversion machine of a "pumped storage" electric utility.

BASIC FORM NO. 4 (FIGS. 10 and 14)

The symmetrical tandem embodiment I, of FIG. 6, operates in either flow direction, with reverse rotation but equal efficiency, as a pump and/or as a turbine. This, non-symmetrical, tandem embodiment II, illustrated in FIG. 10, operates with two-stage efficiency, as a pump in one flow direction, and as a turbine, in the opposite flow direction with reverse rotation.

In FIG. 10 the left half-vane 25L, shown in 12 positions as in FIG. 6, is shorter than the right half vane 25R, and the angularity, of the left, circular segment, transverse, guide track 42L, is more acute than the angularity of the right track 42R. The shorter length, and more acute angularity, of the left half vane, combine to reduce the height and length, respectively, of the left end of the vane surrounding duct. This reduces the displacement of the left end of the duct, relative to the right end. Hence, flow velocity through the duct, from one end to the other, decreases, when operated as a turbine with clockwise rotation and flow from left to right. Conversely, flow velocity increases when operated as a pump, with counterclockwise rotation, and flow from right to left. These conditions improve the laminar characteristic of the flow, in both cases, and are particularly desirable in a two-stage mechanism.

The fluid mechnism of FIG. 10 as shown in FIG. 14 can serve to advantage when hooked up to an electric generator 80 having motoring capability which, in turn, is connected to an electric utility system. The mechanism would be located close to a large body of water, such as a lake 81, near, or somewhat below, the surface level, and near a substantially elevated storage basin 82. In this case, there would be a piped connection 83 from the large end of the duct to the lake, and a similar connection 84, from the small end of the duct, to the low point 85 of the storage basin. In periods of slack electrical demand on the utility, the system would provide the power to drive the mechanism, as a two-stage pump, to pump water from the lake into the elevated reservoir. During heavy demand periods a reservoir outlet would be opened, to drive the mechanism as a two-stage turbine, returning the stored water to the lake and electrical energy to the utility.

BASIC FORM NO. 5 (FIG. 11)

Heretofore in this specification, the basic mechanism forms, 1 through 4, encompassed vane duct enclosures with open ends. In these the fluid power was received from, or sent to, an external or otherwise remote location, and the conversion of power was from fluid to mechanical, or vice-versa. The above-mentioned mechanism forms 1 through 4 may be considered as Case I of the specification.

Figure 11:
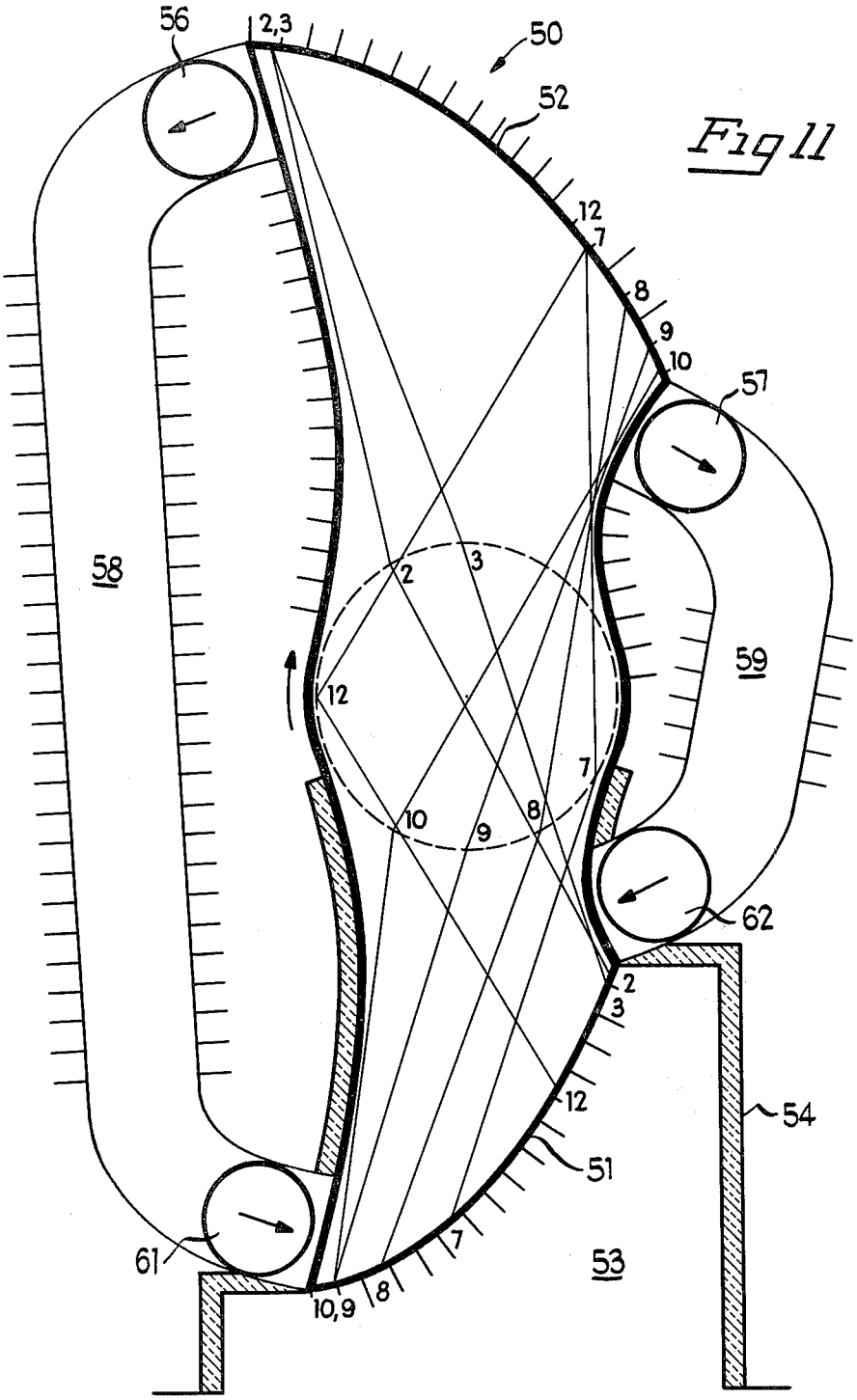
FIG. 11 is a diagrammatic representation of the tandem fluid mechanism embodiment of FIG. 10, as it is employed in the direct conversion of external heat to produce mechanical power.

Case II is exemplified in FIG. 11, in which the mechanism is fully enclosed. The curved walls, such as 31*c* and 33*c* of FIG. 6, are continued closely around the vane end tracks, and joined to the ends of the parallel side walls, to form a tightly sealed chamber 50. The mechanism within the chamber 50, when so enclosed, and equipped as shown in FIG. 11, with valves, ducts, a source of heat at the small, lower, end 51, and utilizing a compressible fluid, such as air or helium, functions as a closed cycle regenerative thermal engine. The exteriors of end walls 51 and 52, of the chamber 50, are finned to improve the transmission of heat, to or from the interior. Supporting the lower section of the chamber 50, the insulated furnace 53, provides a continuous source of heat to the end wall 51. The furnace insulation 54, is extended around the lower portion of the chamber to retain the heat, while the upper portion of the chamber is finned to aid in the dissipation of heat. At the uppermost ends of the chamber, valved openings 56 and 57 are provided leading into ducts 58 and 59 respectively, to return cooling and contracting gas, to the lowermost ends, through non-return, check valves 61 and 62 respectively. The ducts 58 and 59 are also finned to further reduce the gaseous fluid temperature before it enters the heating end of the chamber 50.

Valves 56 and 57 are keyed to, and timed by, the power output shaft at the center of the circular disc. They open and close once in each revolution to exhaust gas driven by pressure on the opposite side of the advancing articulated vane. Check valves 61 and 62 open only on the pressure differential caused by the withdrawing vane. Seven positions of the articulated vane are shown in FIG. 11. Each position denotes the approximate timing of the opening and closing of the valves as follows:

Near 2, 57 opens and 56 closes. Near 3, 62 opens. Near 7 or 8, 62 closes. Near 8, 56 opens. Near 9, 57 closes. Near 10, 61 opens, and near 12, 61 closes. Rotation is clockwise, powered by the continually expanding gas being driven from the hot end. Positive driving torque impulses are imparted to the articulated vane from positions 1 through 5, and from 8 through 10. Momentum rotation conditions exist, between the above pulses, at 5 and 6, and at 11 and 12.

It may be somewhat less than obvious, and therefore warranted to point out that the enclosed mechanism of FIG. 11 can also be utilized, without ducting, or heating and cooling means, as a compressed air powered motor with minor modification of the valves and their timing. To function as an air motor, the check valves 61 and 62 are replaced with valves such as 56 and 57, in this case timed to admit air alternately as the vane withdraws from the valved surface. At the other end, valves 56 and 57 are retained, but timed to exhaust air alternately as the vane advances toward the valved surface. This construction may also be operated as a steam engine, preferably returning exhausted steam to a condenser whence it may be reheated and refed to the inlet side.

BASIC FORM NO. 6 (FIG. 12)

Figure 12:
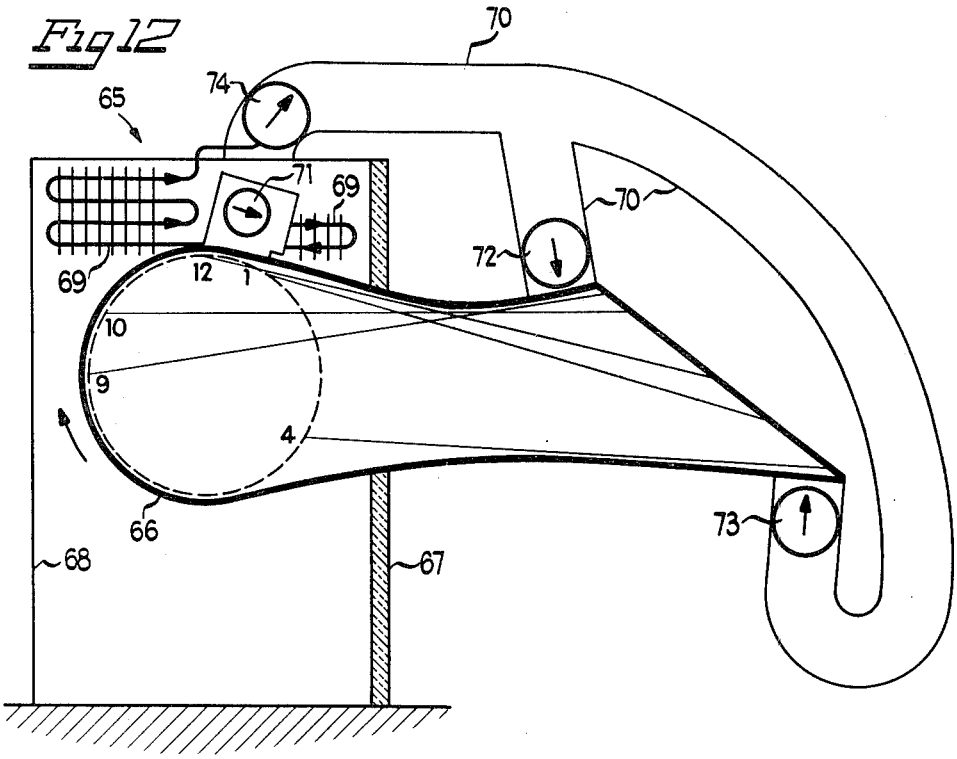
FIG. 12 is a diagrammatic representation of a valved, chambered, single stage mechanism employed as a cryogenic machine or so-called heat pump.

A second exemplification of Case II is provided in the motor driven single stage cryogenic machine, generally indicated by the numeral 65 in FIG. 12. Here, again, the subject mechanism is fully enclosed except, in this case, for three unidirectional check valved openings. The vane's circularly moving and circularly enclosed end 66, the discharging end, is fitted, through a rectangular opening, to the insulated wall 67. The wall 67, in turn, is then assembled to three other walls to form the open ended duct 68 which also serves as a base for the machine.

An evaporator duct 70, having an expansion valve 74 and two of said three check valves in place, is then attached to the base and chamber and connected to a heat transferring condenser 69. The third check valve 71 connects the chamber's discharge opening, placed between 12 and 1, to the inlet of the diagrammatically shown condenser 69. The entire volume of the chamber, plus the condenser and duct 70, is filled with air or another gas or volatile liquid, suitable to the utility selected for the machine. From the condenser 69, the fluid is forced through the small orifice of "expansion" or relief valve 74, into the "evaporator" duct 70, acting as a receiver. Alternate suction movements, in each revolution, at the chamber's right end, of the vane's right end, as it moves away from the two check-valved openings there, then draw in the expanded gas through said check valves 72 and 73.

The operation of the cryogenic machine 65 is quite simply explained: As the vane moves, from about position 4 to position 12, the gas volume above the vane is compressed, and discharged, through the check valve 71, into the heat transferring condenser 69. Heat generated by the compression is carried away from the compressor end and condenser by cold air, or other gas fanned through duct 68. The compressed gas that is forced, from the condenser, through the valve 74, cools, as it expands into the duct 70.

Starting near position 9, check valve 72 opens as the right end of the vane recedes, creating suction for the expanded gas to enter, filling the chamber through this valve until it closes, near position 12 or 1. From the position at which valve 72 closes to a position near 4 when valve 73 opens, no gas will move into, or out of, the chamber. From about position 4, to position 9, the right end of the vane is receding from valve 73, sucking expanded gas into the chamber, through valve 73, below the vane, while the upper side of the vane is compressing the remaining gas in the chamber and ejecting it through check valve 71. Thus, gas is compressed and ejected, from about 4 to 12 or for about two-thirds of each revolution. Gas is returned to the cool end of the chamber from about 9 to 12 through the upper check valve for about one quarter of a revolution, and from about 4 to 9, for about five-twelfths of a revolution through the lower check valve.

When the cryogenic machine is to be employed to liquify a gas, a drain opening would be placed in the duct 70 near valve 74. Chilled gas would be fanned through duct 68 to further cool the compressor end, and the duct 70 and cold end of the chamber would be well insulated. Otherwise, all external surfaces of the chamber and recirculating duct 70 would be finned to improve heat transmission.

If the machine were used space cooling, the entire cool end, chamber and duct would be enclosed in a duct similar to duct 68 and indoor air would be circulated over this cold end and exterior air would be circulated through duct 68. If the machine were used for space heating, as a heat pump, outdoor air would be circulated over the cold end, and indoor air over the compressor end. For improved "cold extraction", the duct 70 would be longer and convoluted.

To attain higher pressure differentials between intake and discharge ends of the subject fluid mechanism it becomes desirable to provide a tight seal between the vane surfaces and the chamber walls. For this purpose, the inner surfaces of the curved top and bottom walls, or the meeting surfaces of the vane, may be covered with a resilient material, permitting actual contact to occur between the two surfaces. When temperatures may be elevated, or unduly cold, the two close surfaces may be provided with slightly negative clearance, i.e. they may actually touch each other, with some pressure, but limited by flexibility designed into the vane, or with external pressure applied to the enclosing walls.

FIG. 13 diagrams a fully enclosing chamber **65*d*, similar to that in FIG. 12 but differing in the flattened shape of the lower wall surface 31*d* and the convexly curved lower surface of the vane 25*d*. The vane is shown near its lowest and outermost position and also, with broken lines, near its uppermost and retracted position, with its flat upper face against the upper wall surface 33*d* and riding on a roller bar 80, placed in the apex of the upper wall surface. A comparison of the curved vane surface and the contiguous wall surface 31*d* of FIG. 13 with a flat vane surface and its contiguous wall, such as surface 31 of FIG. 2 or FIG. 4, will reveal that curving the vane surface meeting contiguous wall 31 results in shortening wall 31 while it lengthens the vane surface. This provision reduces relative sliding motion between the two contiguous surfaces. This provision cannot eliminate such sliding motion completely, much as a roller or ball bearing cannot have pure rolling contact between the rollers or balls and races. However, the modified "rolling" provided herewith more closely approaches pure rolling. The beneficial effect is to permit a light pressure contact between the vane and its contiguous wall surface 31*d***, resulting in greater operating efficiency at higher pressure differentials.

On the other surface of the vane, the contiguous wall **33*d* is shorter than a flat vane's meeting surface. Although the lengths of these two meeting surfaces cannot be made more nearly equal by modifying either surface, an alternative to reducing the relative sliding motion is presented by an apex in the surface 33*d*. At this apex point, the roller bar 80 is mounted to be freely rotatable, as with bearings in the parallel side walls. Contact pressure, and transverse meeting location, of the roller bar with the flat vane surface is controlled by placing the roller bar's shaft ends over springs (not shown) in short transverse guide slots in the side walls. A light pressure of the vane's flat surface on the roller bar 80 will result in more efficient rolling, rather than sliding, as the vane pivots around this apex point while the contact also maintains an excellent pressure seal. This combined vane and meeting wall mechanism embodiment therefore serves to advantage in the fluid energy machine of FIG. 12**, or whenever higher pressure differentials are required.

OTHER MODIFICATIONS

While the foregoing descriptions present specifics, these should not be construed as limitations on the scope of the invention, but rather as exemplifications of preferred embodiments thereof. Other variations are possible. For example, in the obliquely transverse guiding track, when a circular segment: In some cases, instead of rolling back and forth in a grooved track, the ends of axle shaft 26 may swing back and forth, along the circular segment line, on a pair of single mechanical links, each in turn pivoting at its other end, about the segment's center, which is secured in extensions of the parallel supporting walls 16.

A second example can be taken from the embodiment of the articulated vane of FIG. 6. A case can be made for the guide tracks, which are at right angles to each other in FIG. 6 to be positioned parallel to each other instead. In this event, provided that the duct ends are closed, as in FIG. 11, two additional ports would be opened to the chamber at the mechanism's drive center. One opening would be made from 11 to 1 and another from 5 to 7. One valve, such as 56 or 57, in FIG. 11, would be placed at each new, central, port, and at each corner port as in FIG. 11. The corner ports could be timed as exhaust ports when the two added central ports are timed as inlets. In this way the mechanism could also serve as a compressed air motor or steam engine or internal combustion engine.

A third example indicates that it is not essential, in the practice of this invention, that either power shaft 22 project outside of the wall 16. The wall 16 may be fairly thin and of dielectric material. The wheel crank discs 20 can contain one or more pairs of radially opposed permanent magnet poles, and thus serve as the armature of an electric motor or generator. The motor or generator would be completed with stationery field coils on the exterior of walls 16. Thus electric power could either be generated by, or supplied to, the fluid mechanism.

It should be understood that numerous modifications may be made in the preferred forms of the invention without deviating from the broader aspects of the invention. Thus, while the various forms of the invention show a vane supported for movement at one end for pure rotary motion, and the other end for pure reciprocation motion where the back and forth movement thereof fall along the same straight or curved lines, much less preferred forms of the invention could deviate somewhat from these ideal rotary and reciprocation motion patterns without deviating from the broader aspects of the invention.

Also, while the various forms of the invention show or presume a disc like wheel crank, such as 20 in FIGS. 1–3, which eliminates the turbulence that would otherwise be created by a simple crank arm, economic or other considerations of certain constructions could indicate preference for the simple crank arm.

I CLAIM:

1. In a fluid energy machine including at least one fluid engaging vane having substantially parallel side edges, said vane and side edges extending generally in a longitudinal direction while executing an alternating pivotal motion about said vane's longitudinal ends, and receiving or imparting motion to a fluid, the improvement in support means for each vane comprising means cohstraining one end portion of each vane to substantially rotary motion and means constraining the other end portion of each vane to substantially reciprocation motion along lines of reciprocation which cross said longitudinal direction obliquely.

2. The fluid energy machine of claim 1 wherein said vane is located on a marine vehicle and is submerged in a body of water and is rotated at said one end to impel the marine vehicle in said body of water.

3. The fluid energy machine of claim 1 wherein said vane is located in an air stream which imparts movement to said vane so that it acts like a wind mill.

4. The fluid energy machine of claim 1 wherein said reciprocation motion is a substantially pure reciprocation motion in which said other end portion of each vane moves back and forth along the same lines.

5. The fluid energy machine of claim 1 wherein said substantially reciprocation motion of said other end portion of said vane occurs in a single plane.

6. The fluid energy machine of claim 1 wherein said reciprocation motion is a substantially pure reciprocation motion in which said other end portion moves back and forth along the same curved lines.

7. The fluid energy machine of claim 1 wherein said machine is provided with a pair of side walls on opposite parallel edges of said vane where the side walls extend transversely of the opposite faces of said vane and are contiguous to the side edges thereof over the entire range of movement thereof.

8. The fluid energy machine of claim 7 wherein said machine also has a second pair of walls extending transversely between said side walls to form an enclosed conduit for the fluid interacting with said vane.,

9. The fluid energy machine of claim 7 wherein the means constraining an end portion of each vane to rotary motion comprise at least one disc like wheel recessed and mounted for rotation within a side wall having an eccentric bearing therein housing a shaft fixed within and near said end portion of the vane.

10. The fluid energy machine of claim 8 wherein said second pair of walls curve inwardly of the conduit and are positioned to make a moving line contact, each with an opposite face of said vane as it executes its said alternating pivotal motion.

11. The fluid energy machine of claim 10 wherein one of said second pair of curved walls extends from the outermost end of said lines of reciprocation to a point of tangency with said lines of rotary motion and is longer than the other curved wall which extends from the closest end of said lines of reciprocation to another point of tangency with said lines of rotary motion.

12. The fluid energy machine of claim 11 wherein said longer curved wall extends beyond the point of tangency with the lines of rotary motion, along said lines, to a point on the order of a quadrant or more from the point of tangency, whereby the percentage of positive displacement effect of each revolution is increased.

13. The fluid energy machine of claim 11 wherein the side surface of said vane which faces said longer wall surface is convexly curved to reduce relative sliding movement between the two surfaces involved.

14. The fluid energy machine of claim 11 wherein a rotatable support bar is provided at the apex of the shorter curved wall and the side of said vane which faces said shorter curved wall rolls over said bar.

15. The fluid energy machine of claim 10 wherein said curved walls extend closely and fully around the lines of rotary and reciprocation motion of the vane's ends to form a sealed chamber in which fluid on one side of the vane is sealed against fluid on the other side for a substantial portion of each revolution.

16. The fluid energy machine of claim 15 wherein valved openings are placed near the corners of said chamber and the vane is rotated, whereby the machine operates as a cryogenic machine or heat pump.

17. A fluid energy machine comprising: a pair of fluid engaging vanes having substantially parallel side edges, the vanes and side edges extending generally in a longitudinal direction, the vanes being articulated on a common axle shaft located close to common end portions of the vanes, the shaft extending transversely to the side edges, support means for the axle shaft constraining said end portions to lines of substantially rotary motion, and support means constraining the opposite end portions of each vane to substantially reciprocation motion along lines of reciprocation which cross said longitudinal direction obliquely.

18. The fluid energy machine of claim 17 wherein extensions of the straight lines of reciprocation or extensions of the chords of curved lines of reciprocation motion of the two opposite end portions of the vanes are substantially at right angles to each other.

19. The fluid energy machine of claim 17 wherein the lines of reciprocation motion of its two vanes differ in length from each other.

20. The fluid energy machine of claim 17 wherein said vanes are located with their longitudinal direction transversely across the bow of a marine vehicle and are rotated by a reversible motor whereby said bow may be impelled to one side or the other.

21. The fluid energy machine of claim 17 wherein said vanes are assembled within a four walled duct of rectangular cross section and the ends of the duct are closed, forming a chamber, the vanes differ in length, and said valved openings are placed near the four corners of the chamber, and there is provided means for applying heat to the end of the chamber enclosing the shorter vane, and means for circulating gas from the chamber, moving said gas out through the valves placed near the opposite end corners of the chamber and returning same to the chamber through the valves placed near the heated end corners of the chamber provide the rotary motion, whereby the machine operates as a regenerative heat engine.

22. The fluid energy machine of claim 17 wherein the vanes differ in length and engage fluid moving from the longer vane to the shorter vane when operating as a pump and reversely moving, from the shorter vane to the longer vane when operating as a turbine.

23. The fluid energy machine of claim 22 wherein said vanes are assembled within a four walled duct of rectangular cross section and located in a hydroelectric power plant adjacent to two bodies of water, one of which is near the level of the machine and one of which is substantially above, a pipe line joins the higher body of water to the end of the duct surrounding the shorter vane and a continuing pipe line leads from the other end of the duct to the lower body of water, the rotary moving ends of the vanes near the center of the duct drive or are driven by a reversible electric motor and generator machine connected to an electric utility power line whereby electric power from the utility company may power the fluid energy machine, as a two stage pump, to move water from the lower to the higher body when electrical demand is slack, and whereby electric power can be produced, when demand arises, by allowing water from the higher level to fall to the lower level while driving the fluid machine as a two stage turbine and the motor generator machine as a generator.

* * * * *